United States Patent [19]

Kobayashi

[11] Patent Number: 4,516,472

[45] Date of Patent: May 14, 1985

[54] HYDRAULICALLY-OPERATED BREAKING DEVICE

[75] Inventor: Yoshikata Kobayashi, Yokohama, Japan

[73] Assignee: Tokyo Shibaura Denki Kabushiki Kaisha, Kawasaki, Japan

[21] Appl. No.: 329,435

[22] Filed: Dec. 10, 1981

[30] Foreign Application Priority Data

Dec. 26, 1980 [JP] Japan ..... 55-188890
Dec. 26, 1980 [JP] Japan ..... 55-188896

[51] Int. Cl.[3] ..... F15B 15/17; F15B 13/044; F15B 13/043

[52] U.S. Cl. ..... 91/392; 91/417 R; 91/457; 91/459; 91/461; 200/82 R

[58] Field of Search ..... 91/417 R, 461, 457, 91/459, 392; 200/82 R

[56] References Cited

U.S. PATENT DOCUMENTS

| | | | |
|---|---|---|---|
| 2,775,982 | 1/1957 | Canfield | 91/417 R |
| 2,900,960 | 8/1959 | Gratzmuller | 91/417 R |
| 3,969,985 | 7/1976 | Grieger et al. | 91/417 R |
| 4,343,972 | 8/1982 | Bischofberger et al. | 91/417 R |

FOREIGN PATENT DOCUMENTS

| | | |
|---|---|---|
| 2235074 | 7/1982 | Fed. Rep. of Germany . |
| 50-11076 | 4/1975 | Japan . |
| 50-11075 | 4/1975 | Japan . |
| 55-19020 | 5/1980 | Japan . |

*Primary Examiner*—Paul E. Maslousky
*Attorney, Agent, or Firm*—Oblon, Fisher, Spivak, McClelland & Maier

[57] ABSTRACT

A hydraulically-operated breaking device of this invention uses a hydraulically-operated differential piston for driving an electric circuit switching unit, and making and breaking pilot valves for actuating the differential piston. In this device, a control valve operated by the action of the pilot valves includes two poppet valves, and drives an intermediate valve which drives the differential piston. Further, the control valve can perform a quick operation at breaking, and can accomplish a given operation even with use of impulse command signals to operate the pilot valves or even in case of a liquid pressure drop during the operation. Furthermore, the use of an auxiliary valve and an auxiliary switch provides the device with a simultaneous action preventive function, pumping action preventive function, and breaking operation preference function.

7 Claims, 17 Drawing Figures

HYDRAULICALLY-OPERATED BREAKING DEVICE

BACKGROUND OF THE INVENTION

1. Field of the Invention

This invention relates to a hydraulically-operated breaking device capable of making and breaking operations using hydraulic pressure.

2. Description of the Prior Art

Accompanying the development of large-capacity, ultrahigh-voltage transmission systems, there has recently been made an increasing demand for high-performance breaking devices. To meet such demand, there have already been developed gas breaking devices using sulfur hexafluoride gas ($SF_6$ gas) and breaking devices using gas pressure for the driving source. As the transmission systems are further improved in capacity and high-voltage performance, the driving force required for the operation of the breaking devices is increased to a high degree. When using gas pressure, e.g. air pressure, for the driving source, therefore, a tank, cylinder, and various other members of one such breaking device cannot help being bulky, and it is necessary to use a silencer for restraining loud inspiration and exhaust sounds which may be produced during operation.

SUMMARY OF THE INVENTION

The object of this invention is to provide a breaking device including a high-powered, compact driving unit for an electric circuit switching section, which has an improved noise property.

To this end, a breaking device according to this invention uses a hydraulically-operated differential piston for driving a switching section. The differential piston has a small pressure receiving surface at one end and a large pressure receiving surface at the other. A high pressure from a high pressure working liquid source is continually applied to the small pressure receiving surface, while the large pressure receiving surface is subjected to the high pressure or a low pressure from a working liquid in a drainage tank in accordance with selection by a control valve. The level of the working liquid pressure depends on whether making commands are given to a making pilot valve or whether breaking commands are given to a breaking pilot valve.

The breaking device may further be provided with a control valve which has (a) a function to enable the device to perform the same making and breaking operations as the ones responsive to continuous supply of making and breaking commands even if these commands are step signals or impulse signals, (b) a function to enable quick operation of the differential piston in response to the supply of the breaking commands, and (c) a function to accomplish a given operation without interruption even in case of a liquid pressure drop during the breaking operation.

Furthermore, the device of the invention may be provided with an auxiliary valve and an auxiliary switch. In cooperation with the auxiliary switch, the auxiliary valve can give the device a simultaneous excitation preventive function to prevent simultaneous changes of passages responsive to both making and breaking commands despite the simultaneous supply of these commands, a pumping action preventive function to prevent continued automatic repetition of the making and breaking operations, and a breaking operation preference function to prevent the making operation after the end of the breaking operation despite the supply of the making commands during the breaking operation, and the breaking operation is automatically performed to stop the operation of the device after the completion of the making operation when the breaking commands are given during the making operation.

The construction, operation and effect of this invention will be described in detail later in conjunction with a preferred embodiment of the invention.

In the breaking device of the invention with the above-mentioned construction, employing the hydraulic driving system, the driving unit for the switching section is compact, high-powered, and minimized in operating noise. Moreover, the use of the control valve, the auxiliary valve, and the auxiliary switch provides the device of the invention with the functions essential to a breaking device, including the capability of completing a given operation even with use of step or impulse signals for command signals, capability of quick response to breaking commands, capability of a given breaking operation even in case of a liquid pressure drop, simultaneous excitation preventive function, pumping action preventive function, and breaking operation preventive function.

DETAILED DESCRIPTION OF THE PREFERRED EMBODIMENT

Figure 1:
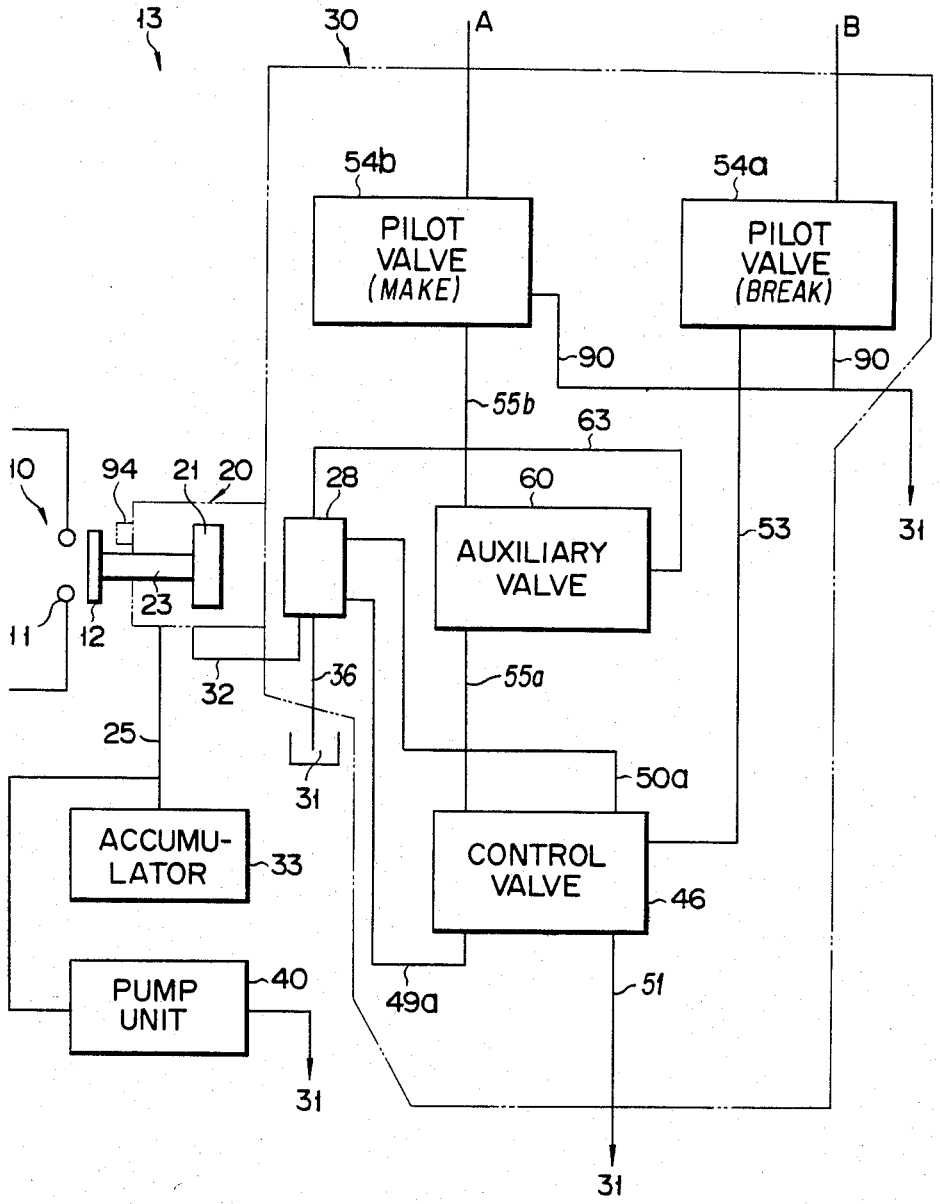
FIG. 1 is a block diagram of a hydraulically-operated breaking device according to an embodiment of this invention.

Now there will be described an embodiment of this invention with reference to the accompanying drawings. FIG. 1 is a block diagram showing the configuration of a hydraulically-operated breaking device 13 according to the invention. A switching unit 10 of the breaking device 13 is disposed in the central portion of the left end of FIG. 1. The switching unit 10 is composed of fixed and movable contacts 11 and 12. The movable contact 12 is attached to the tip end of a differential piston 21 included in a driving unit 20. Besides the switching unit 10 and the driving unit 20, the device 13 is provided with a control unit 30 which cooperates with the driving unit 20. Referring now to FIG. 1, there will be described an outline of the device 13. In FIG. 1, the control unit 30 is exaggerated in size as compared with the driving unit 20.

Figure 1A:
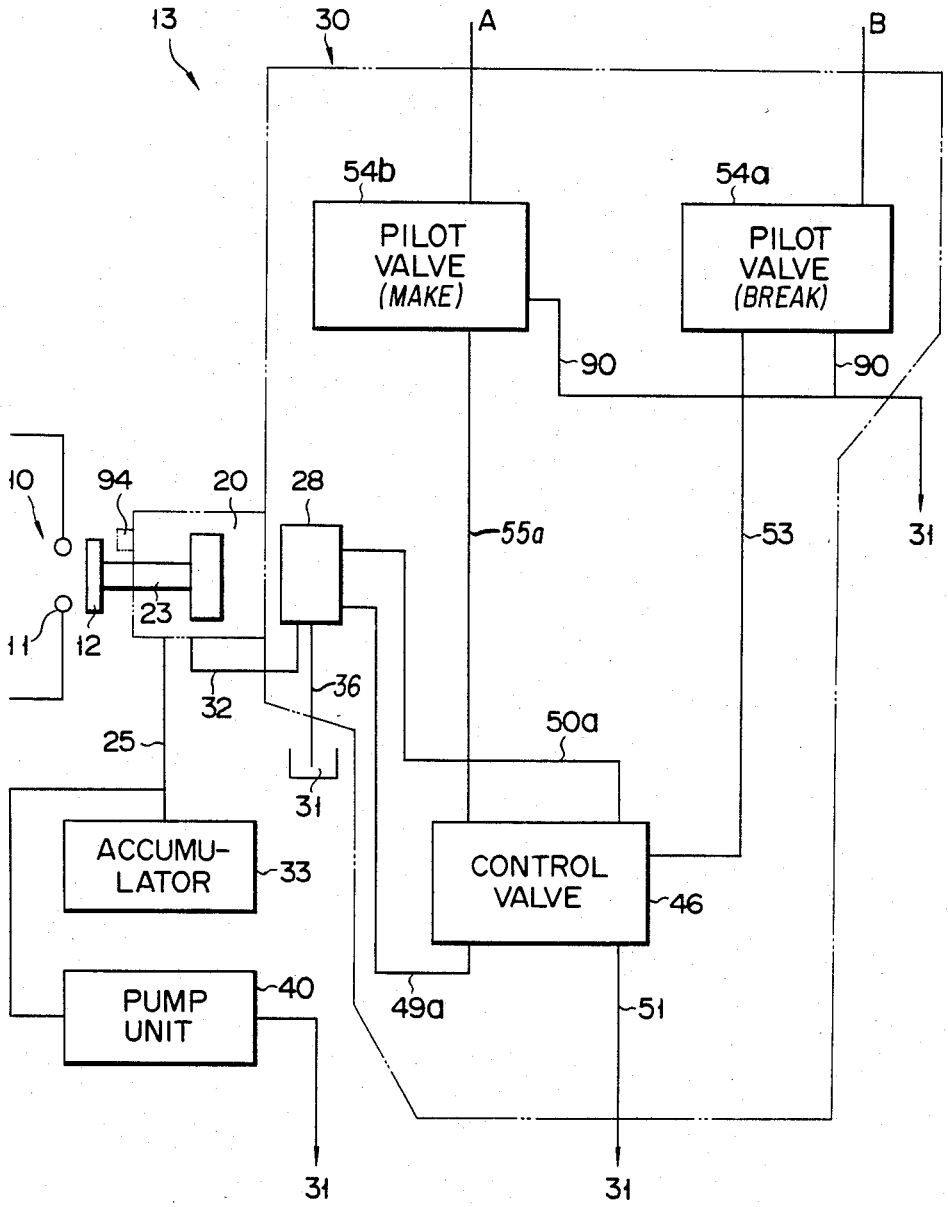
FIG. 1A is a block diagram of a hydraulically-operated breaking device according to another embodiment of the invention.

In cooperation with an accumulator 33, a pump unit 40 serving as a high-pressure working liquid source supplies a high-pressure working liquid to the driving unit 20 and the control unit 30 through passages 25 and 32. The working liquid discharged from the device 13 is returned to a drainage tank 31 for reuse. In FIG. 1, the drainage tank 31 is located in a multitude of positions for the simplicity of illustration. An intermediate valve 28 is disposed in the vicinity of the differential piston 21 so that the pressure of the working liquid applied on the right or rear side of the differential piston 21 may be changed when the intermediate valve 28 is switched. A control valve 46 included in the control unit 30, which is actuated when a pilot valve 54*a* for break or a pilot valve 54*b* for make is driven, drives the intermediate valve 28 to move the differential piston 21 forward or backward, thereby closing or opening the switching unit 10. The pilot valves 54*a* and 54*b* are electromagnetic valves which are supplied with command signals by means of conducting wires A and B, respectively. An auxiliary valve 60 cooperates with an auxiliary switch 94 which is closed when the differential piston 21 is moved to its foremost position. The control valve 46 and the auxiliary valve 60 have a function to give desired functions to the breaking device (these functions will be described in detail hereinafter). If the working conditions allow the breaking device to be simplified in construction, it is unnecessary to use the auxiliary valve 60. FIG. 1A shows a block diagram for such case. Now there will be described in detail the constructions and operations of various parts of the device 13 of the invention the outline of which has been described above.

Figure 2:
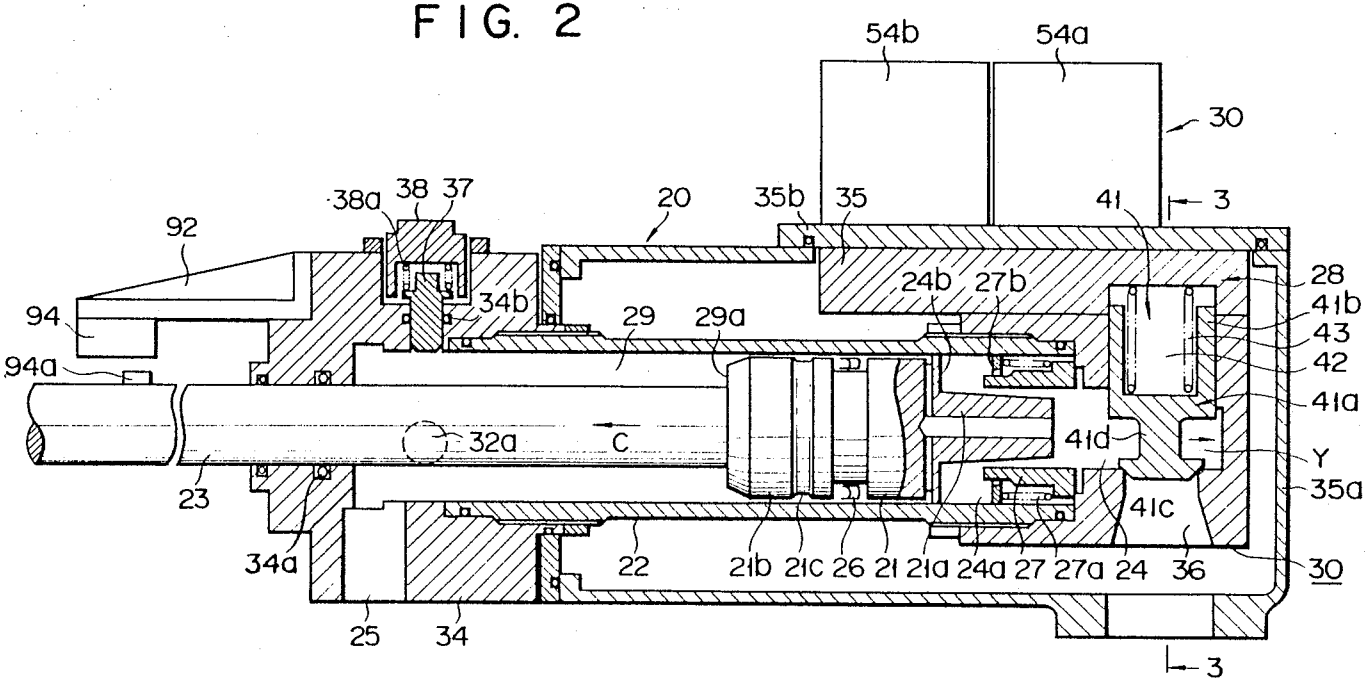
FIG. 2 is a sectional view showing a driving unit and parts of a control unit of the device shown in FIG. 1.
Figure 3A:
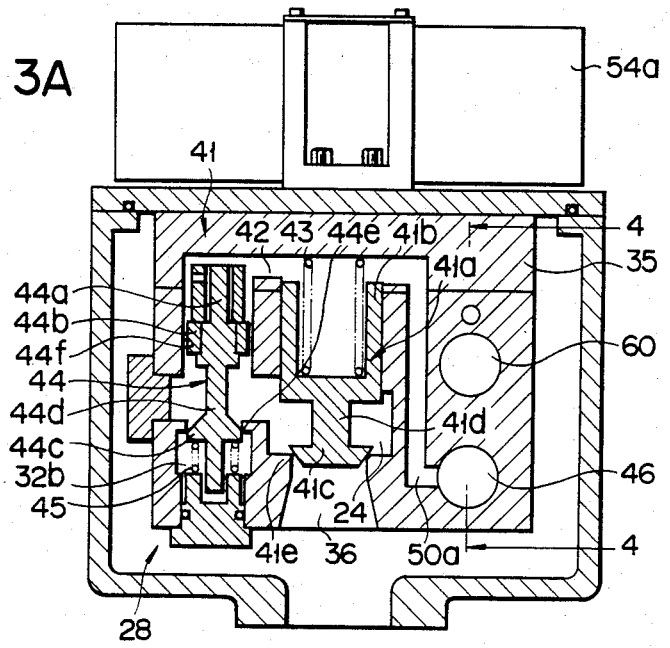
FIGS. 3A, 3B and 3C are sectional views taken along line 3—3 of FIG. 2, severally illustrating three steps of operation of an intermediate valve motion.
Figure 3B:
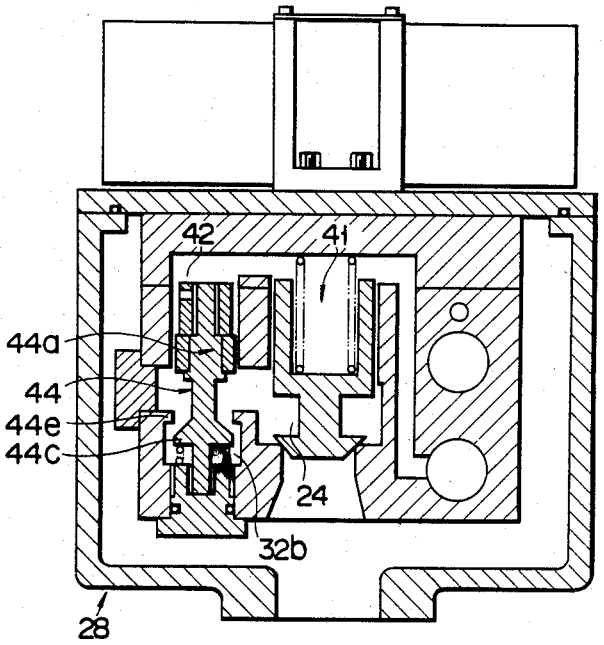
Figure 3C:
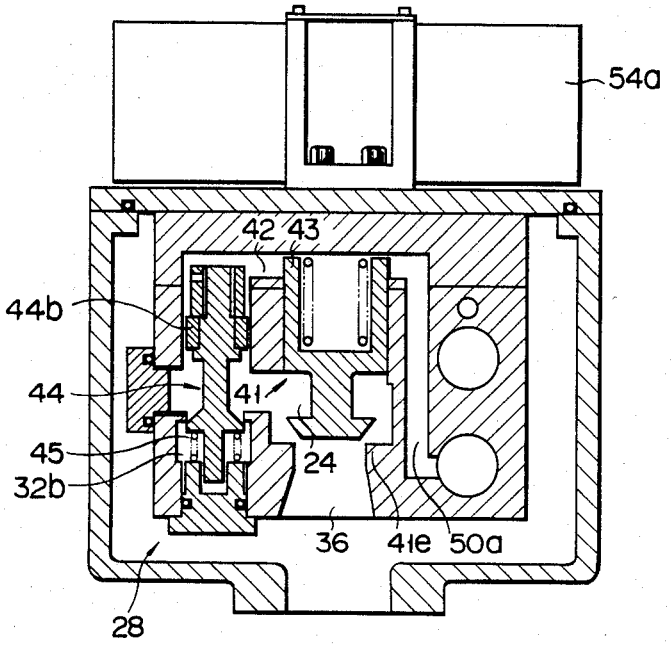

FIG. 2 shows in section the driving unit 20 and part of the control unit 30, that is, the intermediate valve 28. FIGS. 3A to 3C are sectional views taken along line 3—3 of FIG. 2, while FIGS. 4A to 4D are sectional views taken along line 4—4 of FIG. 3A. Symbols A, B, C and D attached to the drawing numbers correspond to the states of the control valve 46, and the auxiliary valve 60 at the start of making operating, immediately after the end of making operation, at the start of breaking operation, and at the end of breaking operation of the device 13, respectively.

In FIG. 2, a piston rod 23 fitted at the front end with the movable contact 12 is extended from the differential piston 21. The piston 21 is inserted in a cylinder 22 with a packing 26 interposed between them. The front and rear ends of the cylinder 22 are fitted with blocks 34 and 35, respectively, and a packing 34*a* is interposed between the piston rod 23 and the block 34. Covers 35*a* and 35*b* are disposed between the blocks 34 and 35 and around the block 35, respectively, and a pilot valve 54*a* for break and a pilot valve 54*b* for make are mounted on the cover 35*b*. Cushion pistons 21*b* and 21*a* are disposed in front and in back of the differential piston 21, respectively. A cushion ring 27 is fitted in the cylinder 22 so as to be able to slide back and forth, and is pressed against the block 35 by a spring 27*a* with one end abutting against a ring 27*b* which is fixed inside the cylinder 22. A front chamber 29 is defined between the front portion of the cylinder 22 and the piston rod 23, while a rear chamber 24 is defined at the rear portion of the cylinder 22. The area of a front pressure receiving surface 29*a* of the differential piston 21 which is subjected to pressure from the front chamber 29 is smaller than the area of a rear pressure receiving surface 24*b* of the differential piston 21 which is subjected to pressure from the rear chamber 24. The block 34 is provided with the passage 25, and the front chamber 29 communicates with the accumulator 33 and the pump unit 40 (FIGS. 1 and 2) by means of the passage 25. A circle described in broken line on the piston rod 23 indicates an opening 32*a* through which the passage 32 (FIG. 1), which connects the front chamber 29 and the intermediate valve 28 (FIG. 3A) in the block 35, opens into the front chamber 29. When the differential piston 21 is moved to its substantially foremost position in the making operation of the device 13, the cushion piston 21*b* blocks up the opening 32*a* to cut off the front chamber 29 from the intermediate valve 28, and the forward motion of the differential piston 21 is checked.

Also the block 34 is provided with a plunger 37 which is sealed with a packing 34*b* and can slide in the radial direction of the cylinder 22. The tip end of the plunger 37 can be projected into the front chamber 29 by a spring 38*a* which is fitted in a case 38 fixed to the block 34. When the force produced by the pressure of the working liquid in the front chamber 29 is greater than the biasing force of the spring 38*a*, the tip end of the plunger 37 is never projected into the front chamber 29. When the liquid pressure inside the front chamber 29 is lowered, on the other hand, the plunger 37 is projected toward a concavity 29*c* formed around the differential piston 21 to check the movement of the differential piston 21, since the plunger 37 faces the concavity 29*c* when the differential piston 21 is moved to the foremost position. When the pressure inside the front chamber 29 increases it forces the plunger 37 into the case 38, thereby allowing the differential piston 21 to move to the right.

Figure 4A:
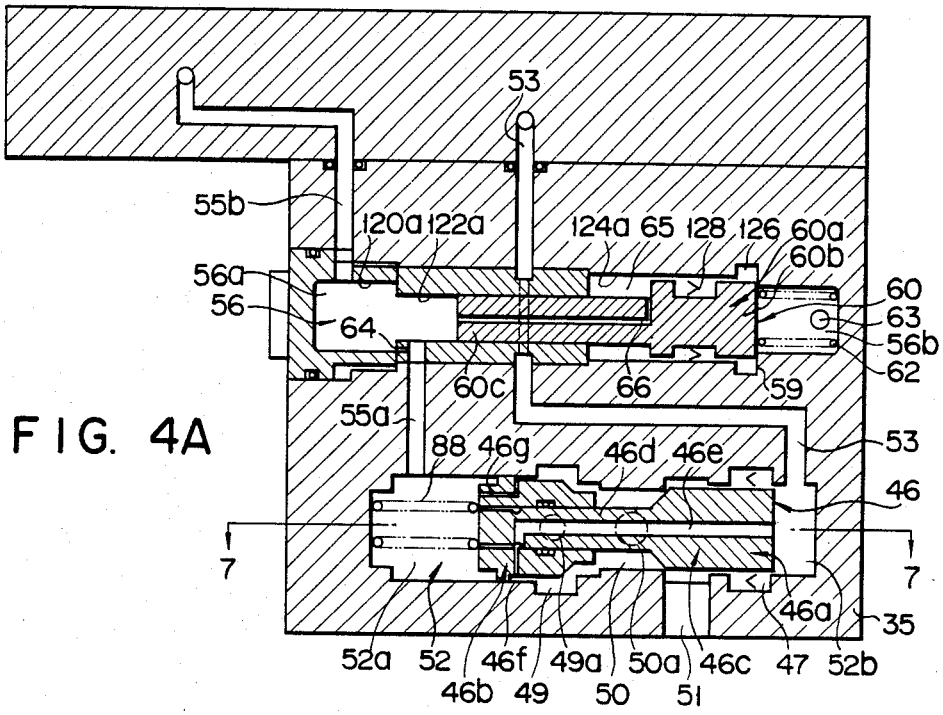
FIGS. 4A, 4B, 4C and 4D are sectional views taken along line 4—4 of FIG. 3A, severally illustrating four steps of operation of a control valve and an auxiliary valve.
Figure 5:
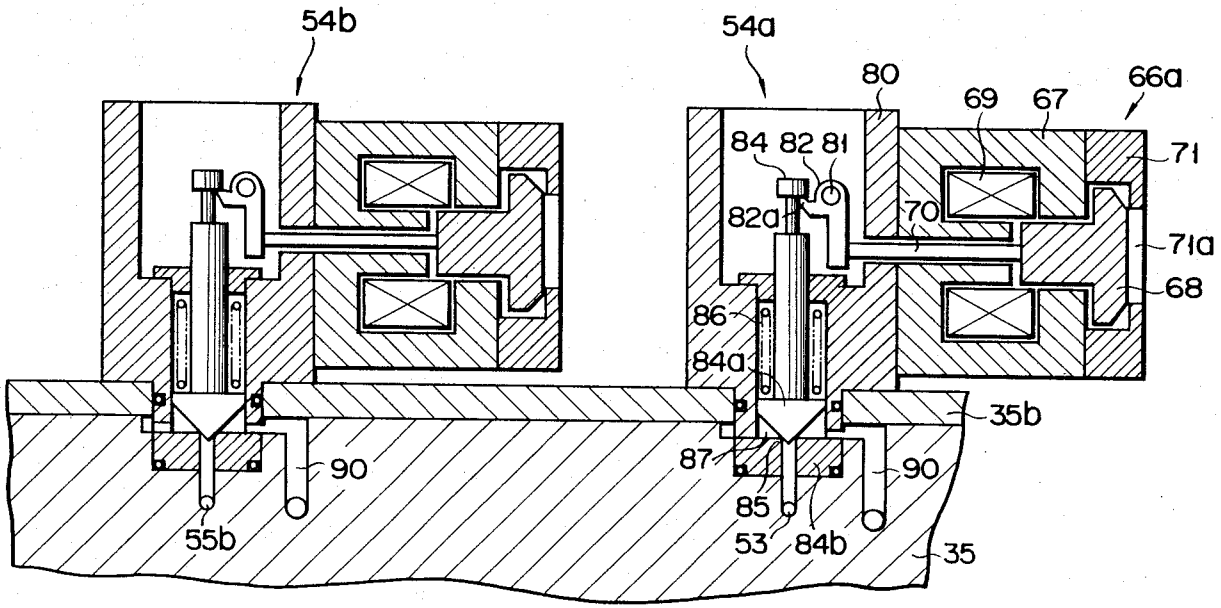
FIG. 5 is a sectional view of pilot valves for make and break shown in FIG. 2.

As shown in FIG. 1, the control unit 30 comprises the intermediate valve 28 (FIGS. 2 and 3A) including a breaking main valve 41 and a making main valve 44, the control valve 46 (FIG. 4A), the auxiliary valve 60 (FIG. 4A), and the pilot valves 54*a* and 54*b* for break and make (FIGS. 2 and 5). The constructions of these valves are as shown in FIGS. 2, 3A, 4A and 5.

A main valve plug 41*a* forming the breaking main valve 41 shown in FIG. 3A is composed of a piston portion 41*b*, a valve plug portion 41*c*, and a connecting portion 41*d*. Defined over the piston portion 41*b* is a pressure chamber 42 connected with the control valve 46 shown in FIG. 4A. Fitted in the pressure chamber 42 is a return spring 43 which urges the main valve plug 41*a* toward the valve plug portion 41*c* or downward. The valve plug portion 41*c* cooperates with a valve seat 41*e* in the block 35. The connecting portion 41*d* is inserted in the rear chamber 24 which is injected with the working liquid to press the differential piston 21 forward. The outside diameter of the piston portion 41*b* is greater than the diameter of the valve seat 41*e*. When the working liquid pressure inside the pressure chamber 42 is lowered to raise the breaking main valve 41 against the biasing force of the spring 43, the rear chamber 24 is allowed to communicate with the drainage tank 31 by means of the passage 36.

FIG. 3A is a sectional view taken along line 3—3 of FIG. 2. A main valve plug 44*a* forming the making valve plug 44 shown in FIG. 2 is vertically slidably fitted in a position adjacent to the breaking main valve 41 in the block 35. The main valve plug 44*a* is composed of a piston portion 44*b* located in the upper position, a valve plug portion 44*c* located in the lower position, and a connecting portion 44*d* connecting these upper and lower portions. The valve plug portion 44*c* is projected into a pressure chamber 32*b* communicating with the front chamber 29 by means of the passae 32 (FIG. 1), and is urged upward by a return compression spring 45 fitted in the pressure chamber 32*b*. The piston portion 44*b* is projected into a chamber containing the working liquid under the same pressure as the liquid pressure inside the pressure chamber 42. The connecting portion 44*d* is disposed inside the rear chamber 24. When the main valve plug 44*a* of the making main valve 44 is lowered to separate the valve plug portion 44*c* from the valve seat 44*e*, the pressure chamber 32*b* is allowed to communicate with the rear chamber 24. Since no packing is interposed between the piston portion 44*b* and a cylinder hole 44*f* surrounding the same, a small portion of the working liquid in the rear chamber 24 and the pressure chamber 42 and leak through a narrow clearance between the outer circumferential surface of the piston portion 44*b* and the cylinder hole 44*f*. Upper and lower circles arranged substantially in a vertical line at the right-hand portion of the block 35 of FIG. 3A indicate the positions or the auxiliary valve 60 and the control valve 46, respectively.

The control valve 46 shown in FIG. 4A includes a control valve plug 46*a* which is fitted in a control chamber 52 defined in the block 35. A chamber 52*a* for make (or making chamber) and a chamber 52*b* for break (or breaking chamber) are defined on the left and right of the control valve plug 46*a* in the control chamber 52, respectively. The making chamber 52*a* is coupled with the making pilot valve 54*b* by means of a passage 55*a*, an auxiliary chamber 56*a* for make defined in the auxiliary valve 60, and a passage 55*b*, while the breaking chamber 52*b* is coupled with the breaking pilot valve 54*a* by means of a passage 53. The control valve plug 46*a* is provided with first and second poppet valve plugs 46*b* and 46*c* formed on the left and right sides of FIG. 4A, respectively. These poppet valve plugs 46*b* and 46*c* are connected by means of a connecting portion 46*d* thinner than them. The right end portion of the second poppet valve plug 46*c* is surrounded by a packing 47 fitted in the block 35, so that the working liquid on each side of the packing 47 will never pass through the outer circumference of the second poppet valve plug 46*c*. The outer circumferential surface of the control valve plug 46*a* and the inner surface of the control chamber 52, which have complicated configurations, are simplified in FIGS. 4A to 4D, and are shown in detail in FIGS. 7A to 7C which are sectional views taken along line 7—7 of FIG. 4A. These sectional views are intended to illustrate a second passage 49*a* (FIG. 1) connecting the pressure chamber 32*b* under the valve plug portion 44*c* of the making main valve 44 (FIG. 3A) with the control chamber 52, and a first passage 50*a* (FIG. 1) connecting the pressure chamber 42 of the breaking main valve 41 (FIG. 3A) with the control chamber 52.

Figure 7A:
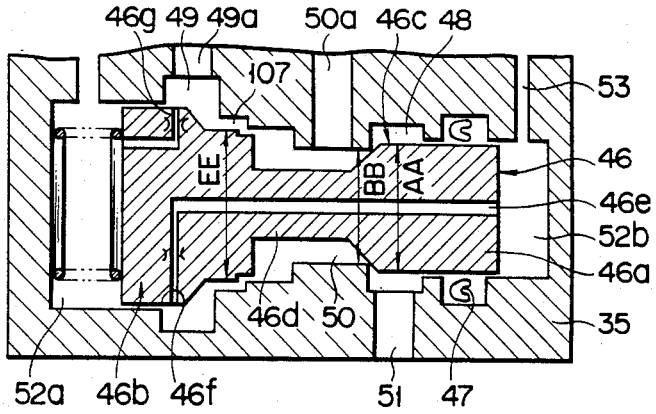
FIGS. 7A, 7B and 7C are enlarged sectional views taken along line 7—7 of FIG. 4A, illustrating in detail the construction and three steps of operation of the control valve shown in FIG. 4A.
Figure 7B:
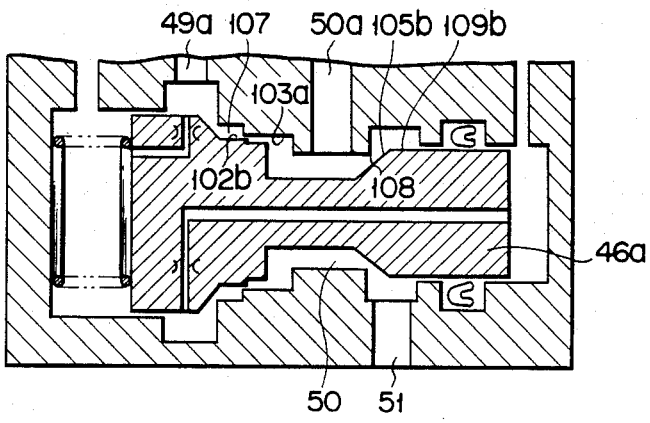
Figure 7C:
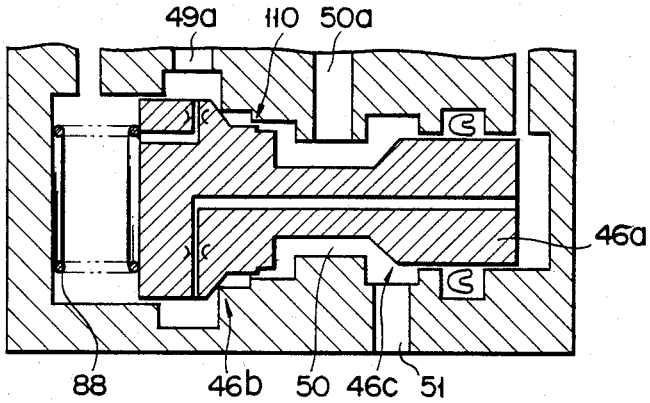
Figure 7D:
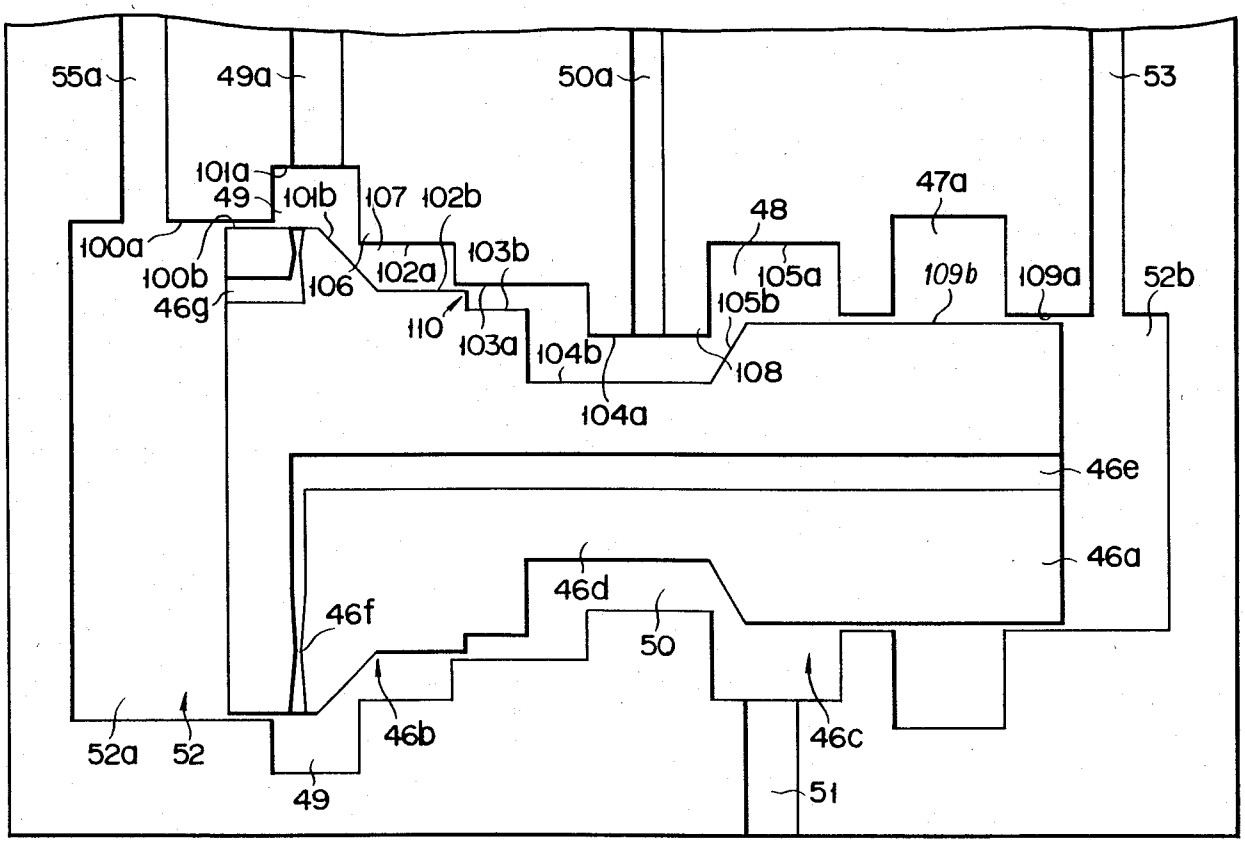
FIG. 7D shows in detail the inner and outer peripheral surfaces of the control valve of FIGS. 7A to 7C.

The complicated configurations of the control chamber 52 and the control valve plug 46*a* are shown in an enlarged view of FIG. 7D. FIG. 7D is used only for the purpose of illustrating the configurations, and the hatching, as well as the packings and springs, shown in FIGS. 7A to 7C is omitted in FIG. 7D for simplicity of illustration. In FIG. 7D, the inner circumferential surface of the control chamber 52 includes an inner circumferential surface portion 100*a* at the left end side of FIG. 7D, an inner circumferential surface portion 101*a* defining a liquid chamber 49, and inner circumferential surface portions 102*a*, 103*a* and 104*a* ranging from the surface portion 101*a* toward the right and successively reduced in diameter. The inner circumferential surface of the control chamber 52 further includes an inner circumferential surface portion 105*a* defining a liquid chamber 48 on the right of the narrowest surface portion 104*a*, a groove portion 47*a* containing the packing 47 (FIG. 4A), and an inner circumferential surface portion 109*a* reaching the breaking chamber 52*b*.

On the other hand, the outer circumferential surface of the control valve plug 46*a* inserted in the control chamber 52 includes an outer circumferential surface portion 100*b* located at the left end side of FIG. 7D and sliding from side to side along the inner circumferential surface portion 100*a*, a conical surface portion 101*b* or the valve plug portion of the first poppet valve plug 46*b* which, adjoining the surface portion 100*b*, is tapered toward the right-hand side so as to abut against a first valve seat 106 formed at the left end of the inner circumferential surface portion 102*a* when the control valve plug 46*a* is moved to the right, an outer circumferential surface portion 102*b* which, adjoining the surface portion 101*b*, defines a liquid chamber 107 between itself and the inner circumferential surface portion 102*a* and additionally defines a narrow restriction portion or spool valve 110 between itself and the inner circumferential surface portion 103*a* when the control valve plug 46*a* is moved to the right, an outer circumferential surface portion 103*b* narrower than the surface portion 102*b* an outer circumferential surface portion 104*b* which forms the outer circumferential surface of the connecting portion 46*d* and defines a liquid chamber 50 between itself and the inner circumferential surface portion 104*a*, a conical surface portion 105*b* or the valve plug portion of the second poppet valve plug 46*c* which, adjoining the surface portion 104*b*, is thickened toward the right-hand side so as to abut against a second valve seat 108 formed at the right end of the inner circumferential surface portion 104*a* when the control valve plug 46*a* is moved to the left, and an outer circumferential surface portion 109*b* wider than the surface portion 104*b* and reaching the breaking chamber 52*b*. The control valve plug 46*a* is provided with a passage 46*e* connecting the breaking chamber 52*b* and the liquid chamber 49 and having a restriction 46*f*, and a passage 46*g* connecting the making chamber 52*a* and the liquid chamber 49 and having a restriction. The making chamber 52*a* communicates with the auxiliary valve 60 by means of the passage 55*a*, the liquid chamber 49 communicates with the pressure chamber 32*b* by means of the second passage 49*a*, and the liquid chamber 50 communicates with the pressure chamber 42 and the drainage tank 31 by means of the first passage 50*a* and a third passage 51, respectively. Further, the breaking chamber 52*b* communicates with the breaking pilot valve 54*a* by means of the passage 53. For the later explanation of the operation of the device of the invention, the diameters of the outer circumferential surface portion 102*b*, the inner circumferential surface portion 104*a*, and the outer circumferential surface portion 109*b* are designated by EE, BB and AA, respectively. When the control valve plug 46*a* moves to the left inside the control chamber 52, the valve plug portion 105*b* abuts against the second valve seat 108 to cut off the communication between the liquid chambers 50 and 48, while the valve plug potion 101*b* is separated from the first valve seat 106 to allow the liquid chambers 49 and 107 to communicate with each other. The liquid chamber 48 is a chamber which is defined between the inner circumferential surface portion 105*a* and the outer circumferential surface portion 109*b* and communicates with the drainage tank 31 by means of the passage 51. When the control valve plug 46*a* moves to the right, on the other hand, the liquid chambers 50 and 48 are allowed to communicate with each other, and the liquid chamber 49 is cut off from the communication with the liquid chamber 107.

The auxiliary valve 60 shown in FIGS. 4A to 4D is fitted in an auxiliary chamber 56 defined substantially in parallel with the control chamber 52 in the block 35. The auxiliary chamber 56*a* for make (or making auxiliary chamber) and an auxiliary chamber 56*b* for break (or breaking auxiliary chamber) are defined on the left and right of the auxiliary valve 60, respectively. The inner circumferential surface of the block 35 defining the auxiliary chamber 56 includes an inner circumferential surface portion 120*a* on the left side of the chamber 56, an inner circumferential surface portion 122*a* formed narrower than the surface portion 120*a* on the right thereof, and an inner circumferential surface portion 124*a* wider than the surface portion 120*a*. A packing groove 126 in which a packing 59 is fitted is formed in that region of the inner circumferential surface portion 124*a* which adjoins the breaking auxiliary chamber 56*b*. An auxiliary valve plug 60*a* is inserted in the auxiliary chamber 56 so as to be able to move axially. The auxiliary valve plug 60*a* is composed of a piston portion 60*b* sliding along the inner circumferential surface portion 124*a*, and a piston rod portion 60*c* protruding from the piston portion 60*b* to the left and sliding along the inner circumferential surface portion 122*a*. A packing 128 capable of sliding along the inner circumferential surface portion 124*a* is fitted on the piston portion 60*b*, and a spring 62 for urging the auxiliary valve plug 60*a* toward the left is fitted in the breaking auxiliary chamber 56*b*. The passage 55*a* communicating with the making chamber 52*a* of the control valve 46 opens near the left end of the inner circumferential surface portion 122*a*, and a narrow leak passage 64 connecting the passage 55*a* and the making auxiliary chamber 56*a* is defined in the vicinity of the open end of the passage 55*a*. The breaking auxiliary chamber 56*b* on the right side of FIG. 4A communicates with the rear chamber 24 (FIG. 3A) by means of a passage 63 (FIGS. 4A and 1). The passage 63 is shown in the block diagram of FIG. 1, and FIG. 4A shows only the opening portion of the passage 63 connected with the breaking auxiliary chamber 56*b*. The passage 55*b* on the left side of FIG. 4A connects the making pilot valve 54*b* and the making auxiliary chamber 56*a*. The piston rod portion 60*c* has a bore 66 which extends longitudinally therein and connects the making auxiliary chamber 56*a* with a liquid chamber 65 defined between the piston rod portion 60*c* and the inner circumferential surface portion 124*a*.

FIG. 5 shows the internal structure of the breaking and making pilot valves 54*a* and 54*b* mounted on the cover 35*b*. The pilot valves 54*a* and 54*b* are solenoid valves which open and close the passage 53 connecting the breaking chamber 52*b* of the control valve 46 with the drainage tank 31, and the passage 55*b* connecting the making auxiliary chamber 56*a* of the auxiliary valve 60 with the drainage tank 31, respectively, in accordance with input signals. Both electrically and mechanically, the pilot valves 54*a* and 54*b* have the same construction and operate in the same manner, except that they include different passages. Accordingly, only the breaking pilot valve 54*a* will be mentioned below. In FIG. 5, a solenoid 66*a* includes a yoke 67, an armature 68, an exciting coil 69, a plunger 70, and a cover 71, and is fixed on a base 80. The plunger 70 is projected to the left when the exciting coil 69 is energized. The same action can be achieved also by pushing the armature 68 to the left through an opening 71*a* formed in the cover 71.

When a lever 82, which is rotatably fitted on a pin 81 fixed on the base 80, is pushed to the left by the plunger 70, it rotates clockwise to cause a valve plug 84 to rise by means of a projected portion 82*a* formed on the lever 82. The valve plug 84 has a conical portion 84*a* at the lower end thereof which opens and closes the passage 53 in cooperation with a valve seat 85 formed on a ring member 84*b* which is attached to the block 35. The conical portion 84*a* is pushed downward by a spring 86 to be brought closely into contact with the valve seat 85 so as to close the passage 53 when the solenoid 66*a* is off. When the exciting coil 69 is energized, however, the valve plug 84 is pulled up to allow the passage 53 to communicate with the drainage tank 31 by means of a liquid chamber 87. In FIG. 5, numeral 90 denotes the passage connecting the liquid chamber 87 and the drainage tank 31 (see FIGS. 1 and 1A).

Figure 8:
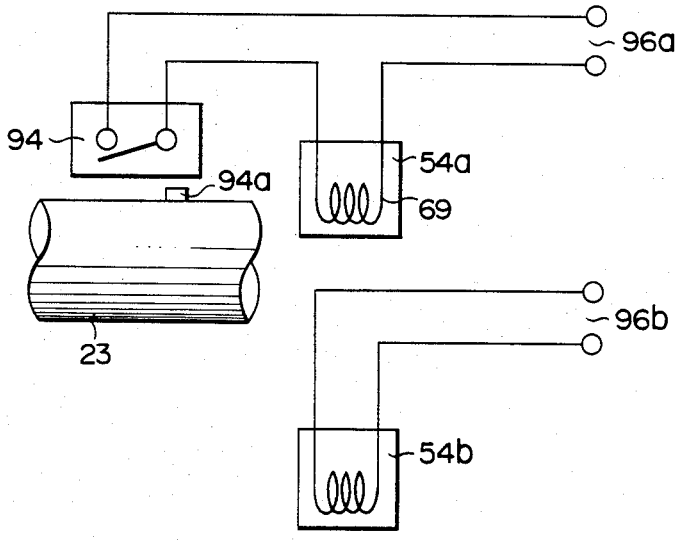
FIG. 8 is a diagram for illustrating an electric circuit related to the pilot valves for make and break and an auxiliary switch shown in FIGS. 2 and 5.

As shown in FIG. 2, a bracket 92 is attached to the left end of the block 34, and is fitted with the auxiliary switch 94 which is turned on when the piston rod 23 is moved to the left through a given stroke. The auxiliary switch 94 may be a switch of any well-known principle, such as an electric or optical switch. A moving member 94*a* attached to the piston rod 23 causes the auxiliary switch 94 to operate when it reaches a predetermined position. FIG. 8 shows an electric circuit which drives the breaking and making pilot valves 54*a* and 54*b*. Terminals 96*a* and 96*b* receive command signals for break and make, respectively. The making pilot valve 54*b* operates immediately when the making command signal from the terminal 96*b* is applied thereto. Even though the breaking command signal from the terminal 96*a* is applied to the breaking pilot valve 54*a*, however, the pilot valve 54*a* operates only while the auxiliary switch 94 is closed. Namely, the pilot valve 54*a* can operate only in a state after the making operation is ended or in a state resembling the same.

Now there will be described the operation of the device of the invention. The hydraulically-operated breaking device 13 of the invention has two stable positions or states. In one of these positions, the differential piston 21 and hence the piston rod 23 are located in left-hand positions, and the switching unit 10 is closed. In the other position, the differential piston 21 and the piston rod 23 are located in righthand positions, and the switching unit 10 is open. Shifting between these two positions is achieved by operating the breaking and making pilot valves 54*a* and 54*b* as required. The operation for such shifting will be mentioned later, and there will first be described an off state of the switching unit 10.

Figure 4B:
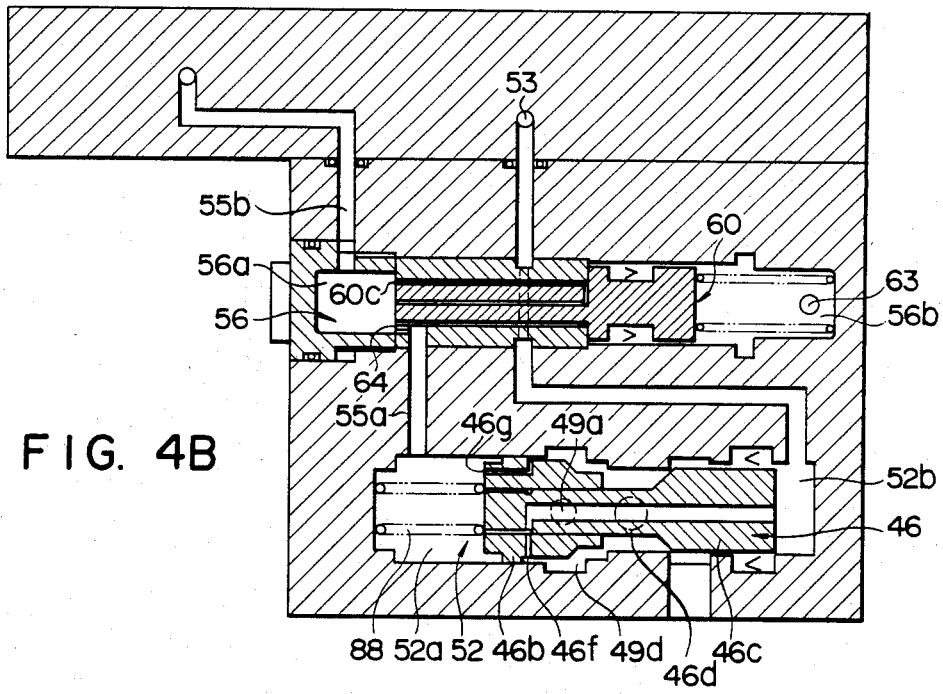
Figure 4C:
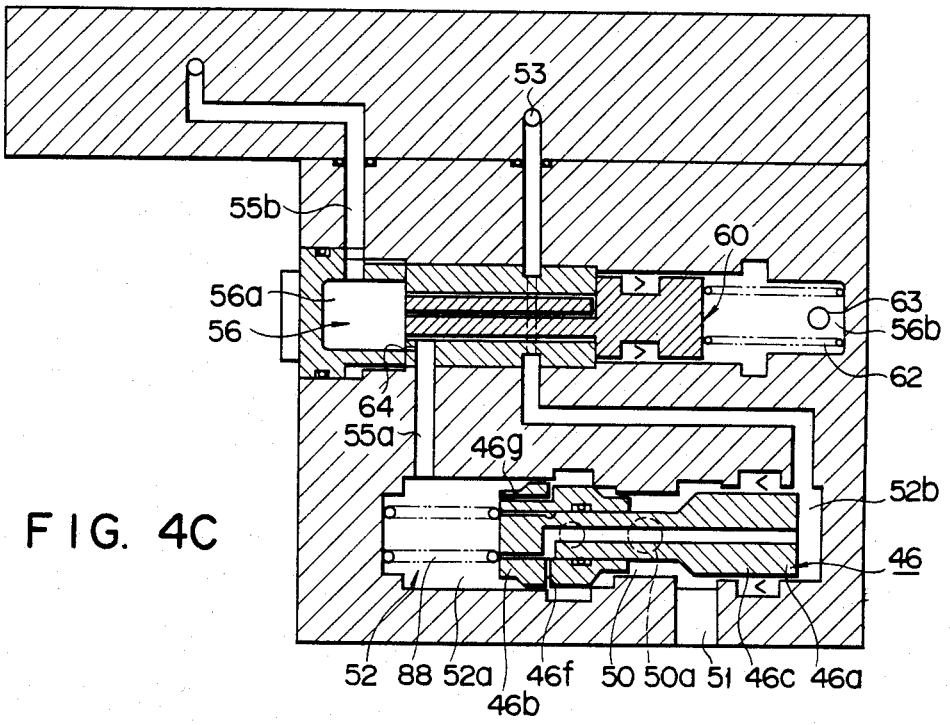
Figure 4D:
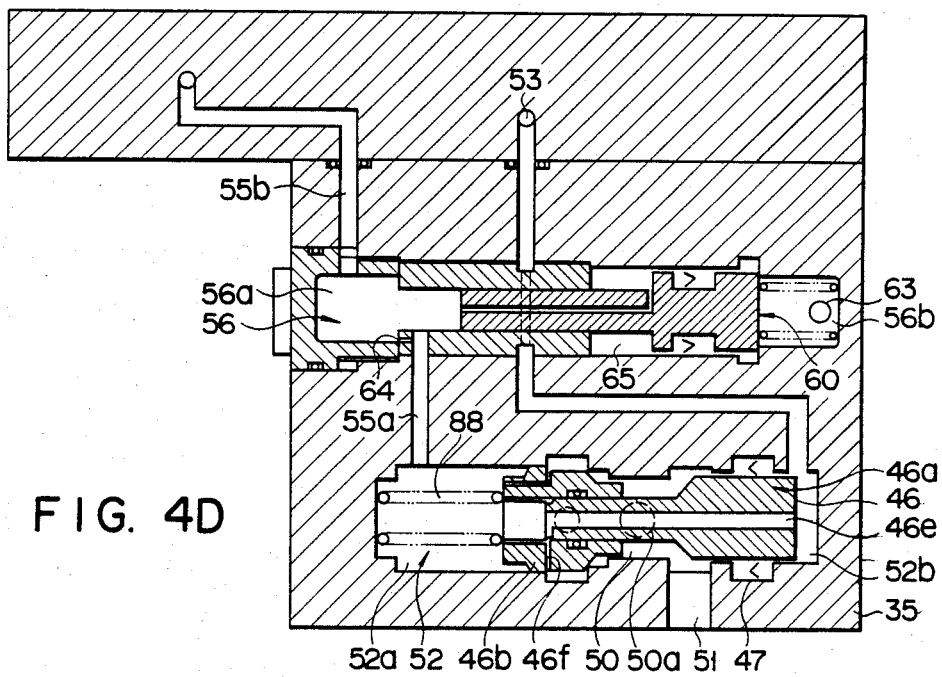

When the device 13 is off, the rear chamber 24 shown in FIG. 2 is under zero or low pressure (hereinafter referred to simply as low pressure). The pressure chamber 42 is also under low pressure, since no packings are used around the piston portion 41*b* of the breaking main valve 41 and the piston portion 44*b* of the making main valve 44 shown in FIG. 3A, allowing a minimal leak. FIG. 4D shows a state in which the control valve 46 and the auxiliary valve 60 are off. In this state, the control valve plug 46*a* is shifted to the right, and the pressure chamber 42 of the breaking main valve 41, the passage 50*a*, and the liquid chamber 50 of the control valve 46 are allowed to communicate with the drainage tank 31, and are kept under low pressure. Also, the breaking auxiliary chamber 56*b* of the auxiliary valve 60 is allowed to communicate with the rear chamber 24 by means of the passage 63 having a restriction, (not shown), and is therefore under low pressure.

Other passages and chambers than those low-pressure members are all under high pressure substantially equal to the pressure of the working liquid supplied from the pump unit 40 as the high-pressure working liquid source.

When the making command signal to energize the exciting coil 69 of the making pilot valve 54*b* is supplied so as to shift the device 13 in the aforementioned off state, the valve 54*b* is actuated to allow the making chamber 52*a*, the passage 55*a*, the making auxiliary chamber 56*a*, the passage 55*b*, and the liquid chamber 87 (FIG. 5) to communicate with the drainage tank 31. Before the making command signal is delivered, the control valve plug 46*a* of the control valve 46 is shifted to the left, and the breaking chamber 52*b* is under high pressure. Therefore, when the making command is issued to lower the pressure inside the making chamber 52*a*, the control valve plug 46*a* is moved to the right. The chamber 52*b* is under high pressure in the off state because the working liquid in the pressure chamber 32*b* under high pressure is supplied to the passage 49A, the making chamber 52*b* through the restriction 46*f* and the passage 46*e*, since the control valve plug 46*a* is located in the right-hand position as shown in FIGS. 4D, 7D so that the first valve seat 106 is brought in contact with the valve plug portion 101*b* to cut off the communication between the second and third passages 49*a* and 51. Further, the pressure chamber 32*b* is under high pressure because it is allowed to communicate by means of the passage 32 and opening 32*a* (FIG. 1) with the front chamber 29 which is supplied with the high-pressure working fluid from the pump unit 40 via the passage 25.

When the control valve plug 46*a* is shifted to the left to bring the control valve 46 into the state of FIG. 4A, the high-pressure working liquid transferred from the high-pressure chmber 32*b* through the second passage 49*a* to the control valve 46 cannot be supplied to the drainage tank 31 due to the contact between the second valve seat 108 (FIG. 7D) and the valve plug portion 105*b*, and is delivered to the pressure chamber 42 of the breaking main valve 41 through the liquid chamber 50 and the first passage 50*a*. The flow of the high-pressure working liquid into the pressure chamber 42 acts as a breaker closing signal. In this case, the pressures inside the pressure chambers 42 and 32*b* are substantially equal. However, since the diameter of the valve seat 44*e* defined between the pressure chamber 32*b* and the rear chamber 24 is smaller than that of the piston portion 44*b*, the making main valve 44 is opened, as shown in FIG. 3B, to cause the high-pressure working liquid in the pressure chamber 32*b* to flow into the rear chamber 24, thereby moving the differential piston 21 to the left or on the direction of arrow C of FIG. 2.

Accompanying the aforesaid action of the control valve 46, the auxiliary valve 60 is driven. Thus, the high-pressure working liquid introduced into the rear chamber 24 is fed into the breaking auxiliary chamber 56*b* through the passage 63. Since the pressure inside the making auxiliary chamber 56*a* is lowered by the action of the making pilot valve 54*b*, the auxiliary valve plug 60*a* is moved to the left (FIG. 4B) by the difference between the working liquid pressures inside the chambers 56*a* and 56*b* on both sides and the action of the compression spring 62. After such movement, the passage 55*a* connecting the making auxiliary chamber 56*a* and the making chamber 52*a* is closed by the piston rod portion 60*c*, allowing the chamber 56*a* and the passage 55*a* to communicate with each other only by means of the leak passage 64. The liquid chamber 49 of the control valve 46 is supplied with the high-pressure working liquid from the pressure chamber 32*b* through the second passage 49*a*, and the working liquid flows out into the making chamber 52*a* through the passage 46*g*. In this case, since the passage 46*g* has a wider cross-sectional area than that of the leak passage 64, the pressure inside the making chamber 52*a* becomes substantially equal to the high pressure inside the liquid chamber 49.

When the making pilot valve 54*b* is released from excitation, the conical portion 84*a* of the valve plug 84 is lowered by the action of the spring 86 to abut against the valve seat 85, so that the communication between the passages 55*b* and 90 (FIG. 5) is cut off. As a result, the pressures inside the passage 55*b*, the making auxiliary chamber 56*a*, the bore 66, and the liquid chamber 65 become substantially equal to the high pressures inside the passage 55*a* and the making chamber 52*a*, and hence the pressure chamber 32*b*, caused by the inflow of the high-pressure working liquid from the leak passage 64.

In the making operation, the differential piston 21 shifted to the left of FIG. 2 restricts the opening 32*a* near the left end of the stroke, thereby throttling the flow of the high-pressure working liquid into the pressure chamber 32*b* and the rear chamber 24. Such restriction of the opening 32*a* provides a cushion effect for the differential piston 21 at the motion limit. When the making operation is ended, the flow of the working liquid from the pressure chamber 32*b* into the rear chamber 24 is stopped, so that the making main valve 44 is surrounded entirely by the high-pressure working liquid.

In breaking the switching unit 10, the breaking pilot valve 54*a* is driven to connect the breaking chamber 52*b* of the control valve 46 with the drainage tank 31. By such operation, the pressures inside the making and breaking chambers 52*a* and 52*b* become high and low, respectively, so that the control valve plug 46*a* is moved to the right, as shown in FIG. 4C. By this movement, the pressure chamber 42 of the breaking main valve 41, the first passage 50*a*, the liquid chamber 50 in the control valve 46, and the third passage 51 are connected with the drainage tank 31 to be brought into the low-pressure state.

Since the pressure chamber 42 is connected to the drainage tank 31, the working liquid within the chamber 42 is discharged, acting on the breaking main valve as a breaker opening signal. At this time, the pressures applied to the top and bottom portions of the breaking main valve 41 are low, and only the connecting portion 41*d* inside the rear chamber 24 is subjected to high pressure. However, since the outside diameter of the sliding part of the breaking main valve 41 is greater than the diameter of the valve seat 41*e* defined by the rear chamber 24 and the passage 36, the breaking main valve 41 moves upward, as shown in FIG. 3C, to cause the high-pressure working liquid in the rear chamber to be discharged through the passage 36 into the drainage tank 31. Thus, the pressure inside the rear chamber 24 becomes low. Accordingly, the differential piston 21 is pushed and moved to the right by the high-pressure working liquid applied from the pump unit 40 to the front chamber 29. The pressure inside the breaking auxiliary chamber **56*b* of the auxiliary valve 60, communicating with the rear chamber 24 by means of the passage 63, becomes low. On the other hand, the pressures inside the making auxiliary chamber 56*a* and the liquid chamber 65 have previously been made high by the high-pressure working liquid supplied from the making chamber 52*a* through the passage 55*a* and the leak passage 64 where the auxiliary valve plug 60*a* is in the left-hand position. Thus, the auxiliary valve plug 60*a* is moved to the right against the compression spring 62 by the difference between pressures applied to both ends of the auxiliary valve plug 60*a***.

As the differential piston 21 moves to the right, the working liquid in a breaking chamber **24*a* defined by the differential piston 21, the cushion piton 21*a*, and the cushion ring 27 of FIG. 2 flows out toward the rear chamber 24. At this time, a gap as the passage of the working liquid defined between the outer circumferential surface of the cushion piston 21*a* and the inner circumferential surface of the cushion ring 27 produces a suitable throttling effect near the end of the rightward motion of the differential piston 21. Such throttling effect prohibits the differential piston 21** from stopping suddenly.

Figure 6:
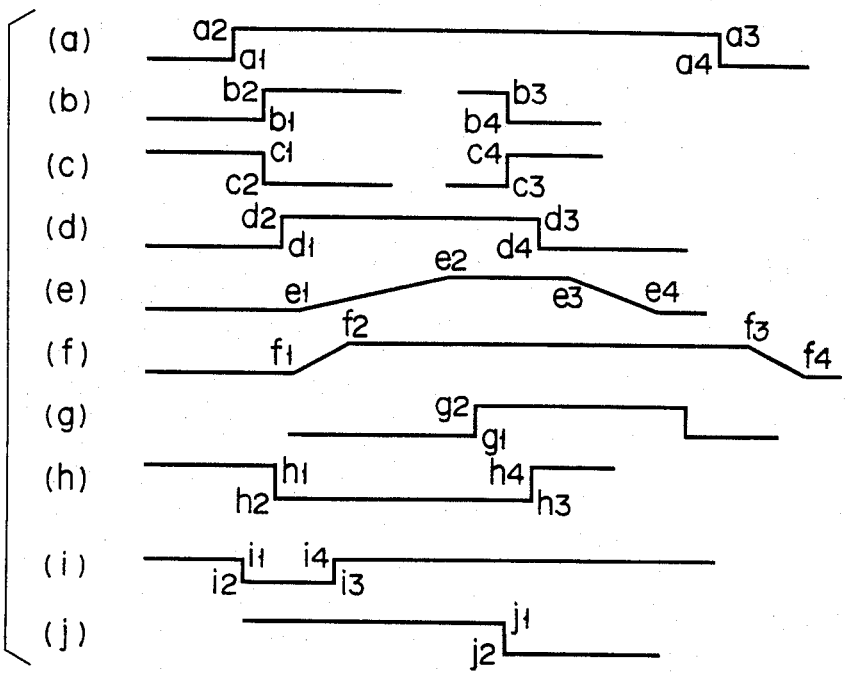
FIG. 6 is a timing chart for illustrating operations of various principal parts of the device of the invention.

FIG. 6 shows the correlation of operation timing between various members of the device shown in the drawing of FIG. 1. In FIG. 6, curve (a) represents the movement of the making pilot valve **54*b*; (b), the movement of the first poppet valve plug 46*b* of the control valve 46; (c), the movement of the second poppet valve plug 46*c* of the control valve 46; (d), the movement of the making main valve 44; (e), the movement of the differential piston 21; (f), the movement of the auxiliary valve plug 60*a*; (g), the movement of the breaking pilot valve 54*a*; (h), the movement of the breaking main valve 41; (i), the pressure change inside the making chamber 52*a*; and (j), the pressure change inside the breaking chamber 52*b*. Now these curves (a) to (j) will be explained successively. First, when the making command is issued, the making pilot valve 54*b* is opened. This action is indicated by the transition from a1 to a2 in curve (a). Thus, a change of the level of each straight line represents an action or reaction of the member concerned, or a change or restoration of pressure inside the member. When the making pilot valve 54*b* operates, the pressure inside the making chamber 52*a* is lowered from i1 to i2 to open the first poppet valve plug 46*b* (the level of curve (b) shifts from b1 to b2; such shift will hereinafter be indicated in such a style as b1→b2) and to close the second poppet valve plug 46*c* (c1→c2) at the same time. Then, the making main valve 44 opens (d1→d2), the high-pressure working liquid is supplied to the rear chamber 24, and the differential piston 21 moves to the making side (i.e., to the left of FIG. 2) (e1→e2). Substantially at the same time, the auxiliary valve 60 moves to the making side (f1→f2). By such movement, the passage 55*a* is closed, and the pressure inside the making chamber 52*a* is raised (i3→i4) by the high-pressure working liquid flowing thereinto from the passage 46*g***.

Now there will be described the way of breaking the device 13 made in the aforementioned manner. When the breaking command is given to the device 13, the breaking pilot valve **54*a* is opened (g1→g2), the pressure inside the breaking chamber 52b is lowered (j1→j2), and the control valve plug 46a is moved to the right of FIG. 4A (c3→c4). On such movement of the control valve plug 46*a*, the making main valve 44 is closed (d3→d4), and the high-pressure working liquid in the rear chamber 24 flows out into the drainage tank 31 through the passage 36. As a result, the differential piston 21 moves to the right of FIG. 2** or to the breaking side (e3→e4).

In this operation it will be noted that even though making commands continues to be given to the pilot valve **54*b* while and after breaking, commands are delivered to the pilot valve 54*a* for the breaking operation, the auxiliary valve plug 60*a* will never move to the left of FIG. 4A, that is, no making operation will be performed. However, once the supply of the making commands is stopped to turn off the making pilt valve 54*b* (a3→a4), the communication between the making auxiliary chamber 56*a* and the drainage tank 31 is cut off to cause the high-pressure working liquid to flow through the leak passage 64 into the making auxiliary chamber 56*a*. Since the pressure inside the breaking auxiliary chamber 56*b*, as well as the pressure inside the rear chamber 24, is low, the auxiliary valve plug 60*a* moves to the right of FIG. 4A (f3→f4), allowing the device 13** to undergo the making operation by the making commands. In other words, once the breaking command is given, the device will positively be turned off even if the making commands are issued, and the making operation will never be prohibited unless the supply of the making commands is once interrupted and then started again.

Referring now to FIGS. 7A to 7C, there will be explained how the device of the invention can stably perform making and breaking operations in accordance with operation command signals, whether step-like or impulsive. First, there will be described a case where the making commands are given till the end of the operation. FIG. 7A shows the state of the control valve 46 after the end of the making operation of the device 13. In this state, the second poppet valve **46*c* is closed, and the liquid chamber 50 is under high pressure. When the pressure inside the breaking chamber 52*b* is made low by the breaking command, the control valve plug 46*a* moves to the right to close the first poppet valve 46*b*, as shown in FIG. 7C. FIG. 7B shows a state in which the control valve plug 46*a* is located halfway between the positions shown in FIGS. 7A and 7C. In FIG. 7B, as the control valve plug 46*a* moves gradually to the left, the communication between the liquid chamber 50 and the third passage 51 is improved gradually. Therefore, the pressure inside the liquid chamber 50 and hence the pressure inside the pressure chamber 42 of the breaking main valve 41 are lowered gradually as the control valve plug 46*a* advances to the left. When the breaking commands are uninterruptedly given, the pressures inside the breaking chamber 52*b* and the liquid chamber 50 both become low, so that the control valve plug 46*a* is located in the position of FIG. 7C**, evidently.

When the supply of the breaking commands is stopped in the middle of the breaking operation, that is, in the state of FIG. 7B, the breaking pilot valve **54*a* is closed to prohibit the working liquid from flowing out of the breaking chamber 52***b* and high-pressure Po in the liquid chamber 50 is introduced into the control chamber 52 through the passage 46*e*. In the device of the invention, the area of inflow from the liquid chamber 49 to the liquid chamber 107, i.e. the area of the first poppet valve plug 46*b*, is wider than the area of outflow from the liquid chamber 107 to the liquid chamber 50, i.e. the passage area of a spool valve 110 defined between the inner circumferential surface portion 103*a* and the outer circumferential surface portion 102*b*, so that the pressures inside the liquid chambers 49 and 107 become high. In this state, the force to move the control valve plug 46*a* to the right is equal to the product of a high pressure Po and the difference between the area SE of a circle defined by the diameter EE (FIG. 7A) of the outer circumferential surface portion 102*b* of the control valve plug 46*a* and the area SA of a circle defined by the diameter AA (FIG. 7A) of the outer circumferential surface portion 109*b*. Since the area SE is larger than the area SA, the control valve plug 46*a* is pushed to the right by a force F1 given by $F1=(SE-SA)\times Po$ to attain the off state as shown in FIG. 7C. The force F1 is calculated on the assumption that the pressures inside the breaking chamber 52*b* and the liquid chambers 49 and 107 are equal to the high pressure Po, ,and that the pressure inside the liquid chamber 50 is zero.

Now let us suppose a case where the making commands are given in the off state shown in FIG. 7C, and the supply of the making commands is stopped when the control valve plug 46*a* has moved through part of its stroke. In FIG. 7C, the liquid chamber 50 is allowed to communicate with the drainage tank 31 by means of the third passage 51 and is under low pressure, while, in FIG. 7B, the flow between the liquid chamber 50 and the passage 51 is throttled and the high-pressure liquid is supplied through the second passage 49*a* into the liquid chambers 49 and 50. Thus, the pressures in both the chambers 49 and 50 are increased. Such pressure increase is accelerated as the control valve plug 46*a*moves to the left. When the control valve plug 46*a* is moved so that the flow of the working liquid introduced through the second passage 49*a* into the liquid passages 49 and 107 becomes greater than the flow of the working liquid escaping from the liquid chambers 49 and 107 to the liquid chamber 50, the pressures inside the liquid chambers 49 and 107 are increased substantially to the level of the high pressure Po. If the pressure inside the liquid chamber 50 is given by P, the control valve plug 46*a* is subjected to the action of the high pressure Po from the breaking chamber 52*a* and the liquid chambers 49 and 107, and to the action of the pressure P from the liquid chamber 50. As a result, the force axially pushing the control valve plug 46*a* includes a rightward force $F1=(SE-SA)\cdot Po$ based on the high pressure Po and a leftward force $F2=(SE-SB)\cdot P$ based on the pressure P. Here SB is the area of a circle defined by the diameter BB of the inner circumferential surface portion 104*a*. The area SB is used here because the liquid chamber 50 under the pressure P and the liquid chamber 48 under zero pressure are located on the left and right of a narrow passage defined between the second valve seat 108 and the valve plug portion 105*b* in FIG. 7B, respectively. The control valve plug 46*a* moves automatically to the left to reach the making position shown in FIG. 7A when F2 becomes greater than F1, that is, when the pressure P inside the liquid chamber 50 is $$P>(SE-SA)/(SE-SB)\cdot Po.$$

Practically, times when the pressure inside the fluid chamber 107 becomes substantially equal to Po at breaking operation and when the pressure P inside the liquid chamber 50 given by $P>(SE-SA)/(Se-SB)\cdot Po$ at making operation are extremely short. Accordingly, an operator may perform making and breaking operations without wrong operation even when push buttons or the like are returned automatically after he pushes them to give making and breaking signals.

Now there will be explained how the device 13 of the invention has a construction capable of operating quickly when it receives the breaking command. The main characteristic of this construction lies in that the difference between the diameters of the outer circumferential surface portion 102*b* of the control valve plug 46*a* and the inner circumferential surface portion 103*a* of the block 35 is small. As a result, when the control valve plug 46*a* is moved from the position of FIG. 7A to the right in response to the breaking command to cause the inner and outer circumferential surface portions 103*a* and 102*b* to face each other as shown in FIGS. 7B and 7C, the inflow of the working liquid from the liquid chamber 107 to the liquid chamber 50 becomes slow due to the throttling effect at the facing region. In this state, the inner and outer circumferential surface portions 103*a* and 102*b* form the spool valve 110. Since the working liquid flows out from the liquid chamber 50 into the drainage tank 31 with force, however, the liquid pressure inside the liquid chamber 50 is drastically lowered to reduce the pressure inside the pressure chamber 42 with rapidity. Consequently, the breaking main valve 41 is immediately opened by the pressure in the rear chamber 24 to start the breaking operation of the device at once. Thus, as the control valve plug 46*a* is moved to the right end of the control chamber 52, such breaking operation can be completed before the control valve 46 is fully switched, as shown in FIG. 4D.

The device 13 of the invention is so constructed that the control valve plug 46*a* will not stop operation in the middle even though the liquid pressure inside the control valve 46 is lowered during the operation. Such pressure decrease occurs when the control valve plug 46*a* ceases to move during the making or breaking operation for some causes, and the working liquid flows out from the liquid passage 49 through the liquid chamber 50 into the passage 51 communicating with the drainage tank 31. This means that the high-pressure working liquid discharged from the pump unit 40 flows out into the drainage tank 31 without producing any high pressure, and hence that the control valve plug 46*a* is not driven in either direction. In order to prevent the control valve plug 46*a* from stopping in this manner, a spring 88 is fitted in the making chamber 52*a*, as shown in FIGS. 7A, 7B and 7C. The spring 88 presses and moves the control valve plug 46*a* toward the right to the off position shown in FIG. 7C. When the control valve plug 46*a* is located in this position, the liquid chamber 49 and the making and breaking chambers 52*a* and 52*b* are filled with the high-pressure working liquid from the liquid chamber 32*b*, and can operate by a make signal supplied to the pilot valve 54*b*.

Now there will successively be described several functions of the device 13 of the invention, including a pumping action preventive function, simultaneous excitation preventive function, and breaking operation preference function. FIG. 4B shows the operating positions of the control valve 46 and the auxiliary valve 60 where the making operation of the device 13 is ended. If making and breaking commands are given simultaneously to the device 13 in this state, the making and breaking pilot valves 54*b* and 54*a* will open at the same time, and the passages 55*b* and 53 will be connected simultaneously with the drainage tank 31 to be reduced in inside pressure. When the pressures inside the passages 55*b* and 53, become low, the auxiliary valve plug 60*a* is moved to the left by the spring 62 or remains to block up the passage 55*a*, allowing the making chamber 52*a* to communicate with the making auxiliary chamber 56*a* only by means of the narrow leak passage 64. As long as the making pilot valve 54*b* is driven, the making auxiliary chamber 56*a* remains under low pressure. Since the passage 46*g* of the control valve plug 46*a* is wider than the leak passage 64, the pressure inside the making chamber 52*a* is hardly lowered. Connected directly with the passage 53, however, the breaking chamber 52*b* is kept under low pressure as long as the breaking pilot valve 54*a* is driven. As a result, the control valve plug 46*a* moves to the right of FIG. 4B. Thus, the device 13 is switched to the off state and maintained therein. However, the auxiliary valve plug 60*a* remains in the position of FIG. 4B without moving to the right, for the making auxiliary chamber 56*a*, connected directly with the passage 55*b*, is under low pressure. The device 13 may be switched to the on state by once interrupting the supply of the making commands and then starting the supply of the making command again. When the supply of the making commands is stopped, the pressure inside the making auxiliary chamber 56*a* is made high by the action of the working liquid flowing thereinto from the making chamber 52*a* through the leak passage 64, thereby moving the auxiliary valve plug 60*a* to the right. As a result, as shown in FIG. 4D, the making chamber 52*a* is allowed to communicate with the making auxiliary chamber 56*a* by means of the passage 55*a*. When the making pilot valve 54*b* is driven, the pressure inside the making chamber 52*a* is lowered rapidly, and the control valve 46*a* is moved to the left for the making operation of the device 13. Even though the making and breaking commands are supplied simultaneously to the device 13 in the on state, there is no possibility of the breaking and making operations being automatically repeated after the end of the making operation. Such function of the device 13 is called the pumping action preventive function.

Now the simultaneous excitation preventive function and breaking operation preference function of the device 13 will be described in detail. The auxiliary switch 94 is so designed as to be closed coactively with the moving member 94*a* only when the piston rod 23 has substantially reached the left-hand motion limit of FIG. 2 in the making operation of the device 13. While the device 13 is off, therefore, the breaking pilot valve 54*a* never operates even though it is supplied with the breaking commands from the terminal 96*a* (FIG. 8), and only the making pilot valve 54*b* can respond to the making commands. Further, if both the making and breaking commands are supplied with the auxiliary switch 94 closed after the end of the making operation, then the passage 55*a* is closed by the auxiliary valve plug 60*a*, as already mentioned in connection with the pumping action preventive function, to prohibit the operation of the device 13 in accordance with the making commands. In this case, only the breaking commands effectively acts to switch the device 13 to the off state. This action is called the simultaneous excitation preventive function.

Moreover, when the breaking commands are supplied during the making operation of the device 13, the auxiliary switch 94 is closed near the start of the making action of the piston rod 23 to make the device 13 ready for the breaking operation. Once the device 13 becomes ready for the breaking operation, the making operation responsive to the making commands is prohibited by the pumping action preventive function even if the supply of the making commands is continued. When the making commands are supplied during the breaking operation, on the other hand, the piston rod portion 60*c* of the auxiliary valve 60 cuts off the communication between the passage 55*a* and the liquid chamber 56, as shown in FIG. 4C, so that the making operation responsive to the making commands cannot be performed. After the auxiliary valve 60 is moved to the right, the making operation of the device 13 is performed only when the making commands are given to the device 13. As described above, the device 13 ceases to operate in the off state in both cases where the breaking commands are given during the making operation and where the making commands are given during the breaking operation. In order to switch the device 13 to the on state thereafter, it is necessary to supply the making commands anew. Such function of the device 13 is called the breaking operation preference function.

What is claimed is:

1. A hydraulically-operated breaking device comprising:

a cylinder (22) into which a working liquid is fed;

a block (34, 35) for supporting said cylinder (22);

a differential piston (21) inserted in said cylinder (22) so as to be able to move axially in the forward and backward directions and defining at the front end thereof a front chamber (29) supplied with a high-pressure working liquid discharged from a high-pressure working liquid source (40) and at the rear end thereof a rear chamber (24), said differential piston (21) having a front pressure receiving surface (29*a*) facing said front chamber (29) at the front end and a rear pressure receiving surface (29*a*) facing said rear chamber (24) at the rear end, the rear pressure receiving surface (29*a*) having a larger area than that of the front pressure receiving surface (29*a*);

a switching unit (10) driven by said differential piston (21) to make and break an electric circuit;

an intermediate valve (28) having a making main valve (44) and a breaking main valve (41), said making main valve (44) being opened by a breaker closing signal and transmitting to said rear chamber (24) the working liquid supplied from said high-pressure liquid source (40) to thereby close said switching unit (10), and said making main valve (44) being closed by a breaker opening signal to thereby prevent the working liquid from being transmitted to said rear chamber (24), and said breaking main valve (41) being opened by the breaker opening signal and discharging the high-presusre working liquid within said rear chamber (24) into a drainage tank (31) to thereby opening said switching unit (10) and said breaking main valve (41) being closed by the breaker closing signal and preventing the working liquid from being discharged;

a control valve (46) having a control valve plug (46*a*) fitted in a control chamber (52) defined in said block (35), said control valve (46) transmitting the breaker closing signal to said intermediate valve (28) to thereby close said switching unit (10) and transmitting the breaker opening signal to said intermediate valve (28) to thereby open said switching unit (10), said control valve plug (46*a*) being inserted so as to be able to slide in one and the other directions in said control chamber (52) communicating with said rear chamber (24), said high-pressure working liquid source (40), and a low-pressure drainage tank (31) by means of first (50*a*), second (49*a*) and third passages (51), respectively, said control valve plug (46*a*) including first and second poppet valve plugs (46*b*, 46*c*) coupled in a straight line and disposed on the sides of said one and the other directions, respectively, chambers (52*a*, 52*b*) for make and break being defined in said control chamber (52), one on said one direction side of said first poppet valve plug (46*b*) and the other on said other direction side of said second poppet valve plug (46*c*), so that said first poppet valve plug (46*b*) connects said first and second passages (50*a*, 49*a*) and supplies the breaker closing signal to said intermediate valve (28) and said second poppet valve plug (46*c*) disaconnect said third passage (51) from said first passage (50*a*) and second passage (49*a*) when said control valve plug (46*a*) is moved in said one direction, and that said second poppet valve plug (46*c*) connects said first and third passages (50*a*, 51) and said first poppet valve plug (46*b*) disconnects said second passage (49*a*) from said first and third passages (50, 51) and said intermediate valve (28) receives a low-pressure signal, i.e., the breaker opening signal, which is supplied through the first passage (50*a*) when said control valve plug (46*a*) is moved in said other direction, and said control valve plug (46*a*) having passages (46*g*, 46*e*) to leak the high-pressure working liquid supplied through said second passage (49*a*) into said making and breaking chambers (52*a*, 52*b*);

a first pilot vaLve (54*b*) for making disposed in a passage connecting said making chamber (52*a*) and said drainage tank (31) and discharging the high-pressure working liquid in said making chamber (52*a*) to move said control valve plug (46*a*) in said one direction when receiving a command for make; and a second pilot valve (54*a*) for breaking disposed in a passage connecting said breaking chamber (52*b*) and said drainage tank (31) and discharging the high-pressure working liquid in said breaking chamber (52*b*) to move said control valve plug (46*a*) in said other direction when receiving a command for break.

2. A device according to claim 1, wherein said control valve includes a spool valve (110) constituted by an inner circumferential surface portion (103*a*) of the block (35) and the outer circumferential surface portion (102*b*) of the first poppet valve plug (46*b*), whereby the working liquid introduced through said second passage into said high-pressure working liquid source (40) is prevented from flowing out of said third passage (51).

3. A device according to claim 2, wherein the outside diameter of said control valve plug (46*a*) forming said spool valve (109) is greater than the diameter of a valve seat (108) cooperating with said second poppet valve plug (46*c*), and the diameter of said control valve plug (46*a*) portion protruding in the breaking chamber (52*b*) is intermediate between said two diameters, said so that said control valve plug (46*a*) may automatically move to a position corresponding to making or breaking operation even when the supply of making or breaking commands is interrupted in the middle.

4. A device according to claim 3, wherein said intermediate valve (28) is fitted in said first passage (50*a*) so as to be supplied with the high-pressure working liquid to connect said rear chamber (24) with said high-pressure working liquid source (40) while said control valve plug (46*a*) is moving in said one direction, and to discharge the high-pressure working liquid in said rear chamber (24) to connect said rear chamber (24) with said drainage tank (31) while said control valve plug (46*a*) is moving in said other direction.

5. A device according to caim 4, further comprising an auxiliary valve plug (60*a*) rectilinearly slidably inserted in an auxiliary chamber (56) defined in said block (35), said auxiliary chamber (56) including auxiliary chambers (56*a* and 56*b*) for make and break adjoining the ends of said auxiliary valve plug (60*a*) on the sides of said one and the other directions, respectively, said breaking auxiliary chamber (56*b*) having an opening for a passage (63) communicating with said rear chamber (24) and said making auxiliary chamber (56*a*) having an opening for a passage (55*b*) communicating with said making pilot valve (54*b*), an opening for the passage communicating with said making chamber (52*a*) being closed by said auxiliary valve plug (60*a*) when said auxiliary valve plug (60*a*) is moved in said one direction, and said making chamber (52*a*) communicating with said making auxiliary chamber (56*a*) by means of a leak passage (64) defined in said block (35), wherein said auxiliary valve plug (60*a*) is moved in said one direction by the pressure difference between both ends thereof to allow the working liquid to be discharged from said making chamber (52*a*) only through said leak passage (64) when said making pilot valve (54*b*) is driven.

6. A device accordiing toclaim 5, further comprising an auxiliary switch (94) connected in series with an exciting coil (69) disposed in said breaking pilot valve (54*a*) so as to be closed only at the making action limit of said differential piston (21).

7. A device according to claim 6, wherein said making chamber (52*a*) contains therein a spring (88) for urging said control valve plug (46*a*) in said other direction.

* * * * *